United States Patent [19]

Akita et al.

[11] Patent Number: 4,688,546

[45] Date of Patent: Aug. 25, 1987

[54] DEODORIZING DEVICE FOR OIL STOVE

[75] Inventors: Kenji Akita, Sakai; Junji Aiga, Nara, both of Japan

[73] Assignee: Sharp Kabushiki Kaisha, Osaka, Japan

[21] Appl. No.: 694,840

[22] Filed: Jan. 25, 1985

[30] Foreign Application Priority Data

| | | | |
|---|---|---|---|
| Jan. 30, 1984 | [JP] | Japan | 59-12979[U] |
| Feb. 1, 1984 | [JP] | Japan | 59-13764[U] |
| Feb. 2, 1984 | [JP] | Japan | 59-14221[U] |
| May 15, 1984 | [JP] | Japan | 59-71331[U] |
| May 15, 1984 | [JP] | Japan | 59-71332[U] |

[51] Int. Cl.[4] ..... F23D 3/32

[52] U.S. Cl. ..... 126/96; 431/29; 431/18; 431/200; 431/315

[58] Field of Search ..... 431/304, 315, 317, 320, 431/344, 121, 200, 201, 18, 88, 302, 298, 29, 30; 126/93, 95, 96

[56] References Cited

U.S. PATENT DOCUMENTS

| | | | |
|---|---|---|---|
| 1,359,176 | 11/1920 | Kenworthy | 431/121 |
| 3,343,586 | 9/1967 | Berchtold et al. | 126/96 |
| 4,424,019 | 1/1984 | Nakamura et al. | 431/201 |
| 4,480,987 | 11/1984 | Mandai | 126/96 |
| 4,486,170 | 12/1984 | Tsukada et al. | 431/88 |

FOREIGN PATENT DOCUMENTS

| | | | |
|---|---|---|---|
| 0129535 | 10/1979 | Japan | 431/88 |
| 0000897 | 1/1980 | Japan | 431/88 |
| 0155028 | 9/1982 | Japan | 431/88 |
| 0164211 | 10/1982 | Japan | 431/317 |

*Primary Examiner*—Samuel Scott
*Assistant Examiner*—H. A. Odar
*Attorney, Agent, or Firm*—Birch, Stewart, Kolasch & Birch

[57] ABSTRACT

An oil stove comprises a combustion wick for burning oil, a device for extinguishing the fire at the combustion wick, and a deodorizing device for absorbing or removing gases causing smells produced when the burning portion at the combustion wick is extinguished. The deodorizing device comprises gas sensing means for detecting the generation of the gas, and suction means responsive to the gas sensing means for absorbing or removing the gas.

16 Claims, 15 Drawing Figures

DEODORIZING DEVICE FOR OIL STOVE

BACKGROUND OF THE INVENTION

The present invention relates to an oil stove and, more particularly, to a deodorizing device for an oil stove for absorbing and removing incomplete combustion gas or unburned gas which is the cause of obnoxious and nasty smells.

In the conventional oil stove, and typically in a movable wick type oil stove, the downward movement of the wick stops the evaporation of oil and the supply of air the thereby extinguish the burning portion at the top of the wick. However, the top of the wick is slightly burning even after starting to extinguish the burning portion at the top of the wick, so that incomplete combustion gas may be inevitably generated for a while, i.e., several seconds or more. After the burning top of the wick is totally extinguished, unburned gases may be generated until the peripherals of the inner and outer wick cylinders are completely cooled down. Accordingly, obnoxious and nasty smells may be emitted by passing the incomplete combustion gas and the unburned gas through an uncooled burner. However, the conventional oil stove cannot remove such obnoxious and nasty smells, and further, the incomplete combustion gas and the unburned gas causing this smell. Therefore, it is desired to provide a deoderizing device for a movable wick type oil stove to remove the obnoxious and nasty smells emitted from incomplete combustion gas or unburned gas.

SUMMARY OF THE INVENTION

Accordingly, it is an object of the present invention to provide a deodorizing device in an oil stove for absorbing or removing gases causing obnoxious and nasty smells, which is produced by extinguishing a burning portion at the combustion means for the oil stove.

It is another object of the present invention to provide a deodorizing device in a movable wick type oil stove for absorbing or removing incomplete combustion gases or unburned gases, which may produce obnoxious and nasty smells by passing itself through an uncooled burner at a high temperature when extinguishing a burning portion at the top of a wick for a movable wick type oil stove.

It is still another object of the present invention to provide a deodorizing device in a movable wick type oil stove for absorbing or removing gases causing obnoxious and nasty smells and, further, for liquefying the removed gases.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

According to one embodiment of the present invention, an oil stove comprises combustion means for burning oil, extinguishing means for extinguishing the flame at the combustion means, and a deodorizing device for absorbing or removing gases causing odors produced when the burning portion at the combustion means is extinguished. The deodorizing device includes gas sensing means for detecting the generation of the gases and suction means responsive to the gas sensing means for absorbing or removing the gases.

According to another embodiment of the present invention, a movable wick type oil stove comprises wick means for absorbing oil so as to burn at the top of the wick means, cylinder means for disposing the wick means in the space formed between the cylinder means, the wick means moving in the vertical direction along a cylinder means, and a deodorizing device for absorbing or removing gases causing smells produced when the burning portion at the top of the wick means is extinguished by moving down at a predetermined position. The deodorizing device comprises movement-sensing means for sensing the movement of the wick means, suction means responsive to the movement-sensing means for absorbing or removing the gases, and timer means in synchronization with the movement-sensing means for determining the operating period of the suction means.

BRIEF DESCRIPTION OF THE DRAWINGS

The present invention will be better understood from the detailed description given hereinbelow and the accompanying drawings which are given by way of illustration only, and thus are limitative of the scope of the present invention and wherein.

DETAILED DESCRIPTION OF THE INVENTION

Figure 1:
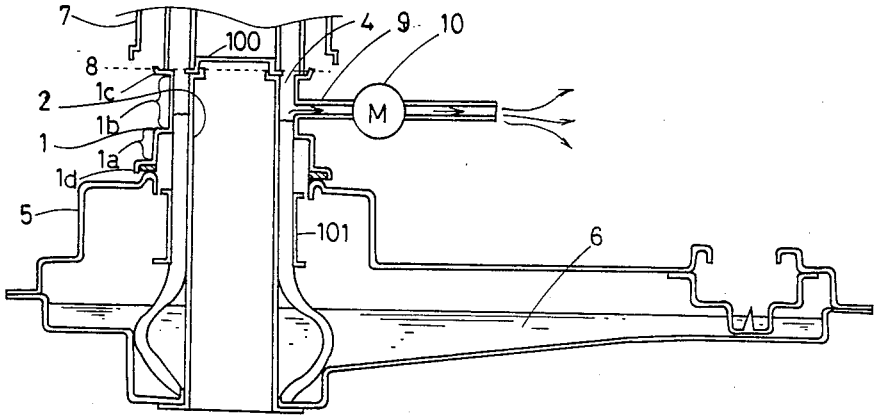
FIG. 1 shows a cross-sectional view of a movable wick type oil stove including a deodorizing device according to a first preferred embodiment of the present invention.

FIG. 1 shows a cross-sectional view of a movable wick type oil stove including a deodorizing device according to a first preferred embodiment of the present invention when extinguished. An outer wick cylinder 1 in a stepwise form rests on a fuel container 5. The outer wick cylinder 1 comprises an upper end portion 1*c* facing outward to constitute a first burner mounting flange, an upper vertical wall 1*b*, a stair portion 1*a* extended outward, and a lower end portion 1*d* facing outward to rest in the fuel container 5. The diameter of the stair portion 1*a* of the outer wick cylinder 1 is greater than that of the upper vertical wall 1*b* of the outer wick cylinder 1. An inner wick cylinder 2 has an upper end portion facing inward to constitute a second burner mounting flange. A burner assembly 7 rests on the first and second burner mounting flanges and generally includes an inner shell, an outer shell and a cylindrical casing all coaxial with a cross pin, a burner handle, and a perforated bottom plate, etc. A wick top plate 100 is positioned at the upper portion of the inner wick cylinder 2 and serves as the perforated bottom plate for controlling the supply of air to a burning portion at the top of the wick from the inner wick cylinder 2. A cylindrical combustion wick 3 is movable in the vertical direction within a wick guide passage 4 between the outer and the inner wick cylinders 1 and 2 with its lowest end being dipped into oil 6 in the fuel container 5 so as to absorb the oil in the upper direction of the cylindrical wick 3 by capillary action. A cylindrical wick holder 101 is provided in the fuel container 5 for holding the wick 3 and is connected with a wick adjust knob (not shown) for raising and lowering the wick 3. According to the revolution of the wick adjustment knob, the wick 3 is moved in the vertical direction with the cylindrical wick holder 101. When the wick 3 is moved, the cylindrical wick holder 101 is moved in the space formed by the stair portion 1*a* of the outer wick cylinder 1.

The stove is adapted for use with paraffin, kerosene or other liquid fuels (referred to generally as "oil" hereafter).

The burner assembly 7 is disposed on the upper portions of the inner and outer wick cylinders 2 and 1. When the oil stove is ignited, the top of the wick 3 projects from the burner rest portion surface 8, so that the top of the wick 3 burns by evaporating the absorbed oil from the surface of the projected wick. When the burning portion at the top of the wick 3 is extinguished, the top of the wick 3 is moved down in the wick guide passage 4 and positioned at the upper vertical wall 1*b* above the stair portion 1*a* of the outer wick cylinder 1, so that the supply of air to the fired top of the wick 3 is terminated. Also, the evaporation of oil occurs only at the brim surface of the top end of the wick 3. Therefore, the burning portion at the top of the wick 3 is can be extinguished gradually.

Even when the top of the wick 3 is moved down in the wick guide passage 4, incomplete combustion gases or unburned gases are produced from the slight or pale portion at the top of the wick 3 when the outer and the inner wick cylinders 1 and 2 are uncooled. If the incomplete combustion gases or the unburned gases are passed through the uncooled burner 7, obnoxious and nasty smells can be emitted by heat resolution of the gas. According to the first preferred embodiment of the present invention, to prevent the incomplete combustion gases or the unburned gases from passing through the uncooled burner 7, a suction pipe 9 is disposed at the upper wall 1*b* of the outer wick cylinder 1 above the position of the top end of the wick 103 when the wick is extinguished. The suction pipe 9 is connected with a suction device including a suction pump 10. Therefore, the incomplete combustion gases or the unburned gases, which may be produced from the slight or pale portion at the entire top of the wick 3 disposed in the wick guide passage 4, are introduced into the suction pipe 9 by driving the suction pump 10 of the suction device and discharged into the atmosphere. Because the incomplete combustion gases or the unburned gases are cooled by passing through the suction pipe 9, the obnoxious and nasty smells cannot be emitted by the gases. The suction pipe 9 may preferably be made of steel.

Figure 2:
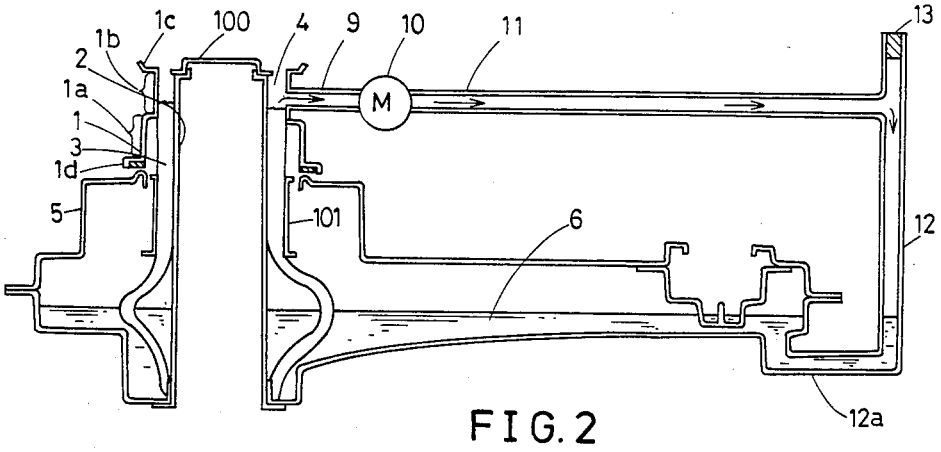
FIG. 2 shows a cross-sectional view of a movable wick type oil stove including a deodorizing device according to a second preferred embodiment of the present invention.

FIG. 2 shows a cross-sectional view of a movable wick type oil stove including a deodorizing device according to a second preferred embodiment of the present invention when the wick 3 is moved down so as to extinguish the burning portion at the top of the wick 3. In the second preferred embodiment, the suction pipe 9, provided at the upper vertical portion 1*b* of the outer wick cylinder 1 above the position of the top of the wick 3 when the wick is extinguished, is connected with the suction pump 10 of the suction device, and further, an exhaust pipe 11, made of steel, having a long passage for the absorbed gases, is connected with the suction pipe 9 through the suction pump 10. The end of the exhaust pipe 11 is divided into two parts. One end of the exhaust pipe 11 is in communication with the atmosphere via a purification filter 13. The other end of the exhaust pipe 11 is connected with one end of an oil feedback pipe 12. A "U" shaped pipe 12*a* is provided at the other end of the oil feedback pipe 12. The end of the "U" shaped pipe 12*a* is connected with the bottom wall of the fuel container 5 so that the suction pipe 9 is communication with the fuel container 5.

The unburned gases or the incomplete combustion gases are introduced into the suction pipe 9 by driving the suction pump 10 of the suction device and the absorbed gases are passed through the exhaust pipe 11. The part of the absorbed gases being passed into the exhaust pipe 11 condenses into a liquid of oil. The liquefied gas oil in the exhaust pipe 11 is introduced into the fuel container 5 through the oil feedback pipe 12 and the "U" shaped pipe 12*a*.

When the wick 3 is moved down lower than the position of the suction pipe 9 along the wick guide passage 4 so that the extinguishment of the burning portion at the top of the wick 3 is performed, the unburned gases or the incomplete combustion gases at a high temperature produced from the top of the wick 3 are absorbed into the suction pipe 9 by driving the suction pump 10. The absorbed gases are gradually cooled by being passed through the exhaust pipe 11 and the gas such as the evaporated oil becomes liquid. The liquefied gas oil is returned into the fuel container 5 through the oil feedback pipe 12 and the "U" shaped pipe 12*a*. Even if the liquefied gas includes some moisture, the oil and the moisture are separated by being passed through the "U" shaped pipe 12*a*, so that only the oil component is supplied to the fuel container 5 because the specific gravity of oil is less than that of moisture. Non-liquefied gas such as the gases without the evaporated oil is discharged into the atmosphere through the purification filter 13. Accordingly, the obnoxious and nasty smells produced by the discharged gases from the exhaust pipe 11 can be eliminated by being purified by the purification filter 13.

Figure 3:
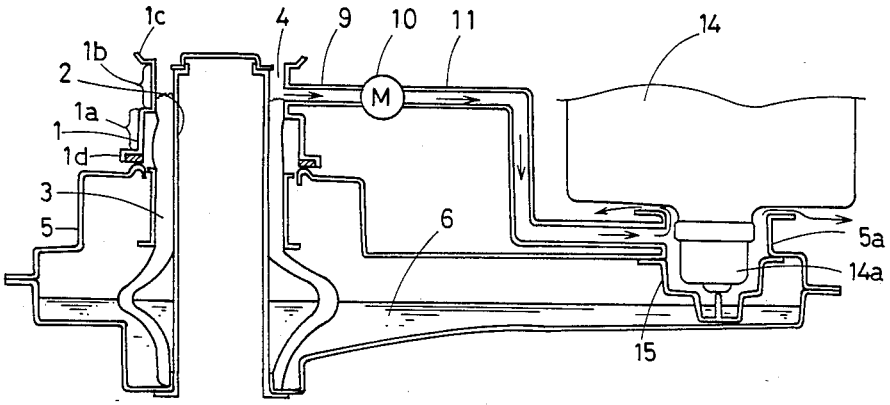
FIG. 3 shows a cross-sectional view of a movable wick type oil stove including a deodorizing device according to a third preferred embodiment of the present invention.
Figure 4:
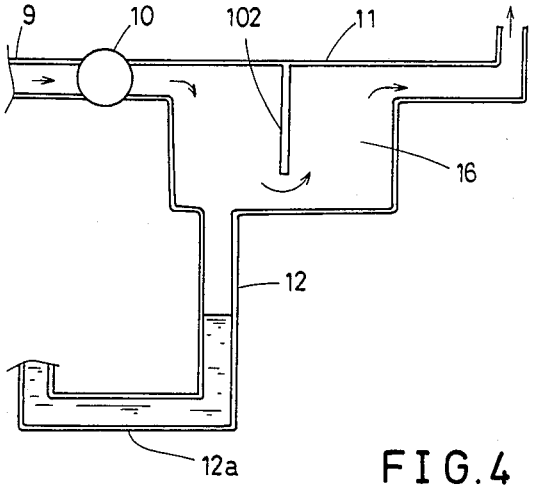
FIG. 4 shows a cross-sectional view of an improved deodorizing device of FIG. 3.

FIG. 3 shows a cross-sectional view of a movable wick type oil stove including a deodorizing device according to a third preferred embodiment of the present invention when extinguished. The exhaust end of the exhaust pipe 11 is provided at an oil supply portion 5*a* of the fuel container 5. An oil supply tank 14 is detachably disposed at the oil supply portion 5*a* so that the oil in the oil supply tank 14 is applied to the fuel container 5 through an oil supply valve 14*a* and an oil saucer 15 when the amount of oil 6 in the fuel container 5 decreases to less than a predetermined amount. When the absorbed gas in the exhaust pipe 11 is forwarded from the exhaust end of the exhaust pipe 11 to the oil supply portion 5*a*, the absorbed gas is condensed into a liquid of oil at the circumference of the oil supply valve 14*a* and the liquefied gas oil is returned into the oil saucer 15. The non-liquefied gas is exhausted along the end walls of the oil supply portion 5*a*. The exhaust pipe 11 may be coiled. Also, as shown in FIG. 4, a barrier 102 may be provided on the inner surface of the exhaust pipe 11 to provide an exhaust duct 16 resulting in a roundabout flow of gas, so that the absorbed gas is quickly liquefied by the exhaust duct 16. The non-liquefied gas is discharged from the end of the exhaust duct 16 to the atmosphere. If the liquefied gas oil is introduced into the fuel container 5 from the oil feedback pipe 12 connected with the bottom wall of the exhaust duct 16, the deodorizing device becomes compact. The exhaust duct 16 may be provided on the inside of the upper wall of the fuel container 5. Although the liquefied gas oil is directly forwarded to the fuel container 5, an additional liquefied gas oil container may be provided for containing the liquefied gas oil.

Figure 5:
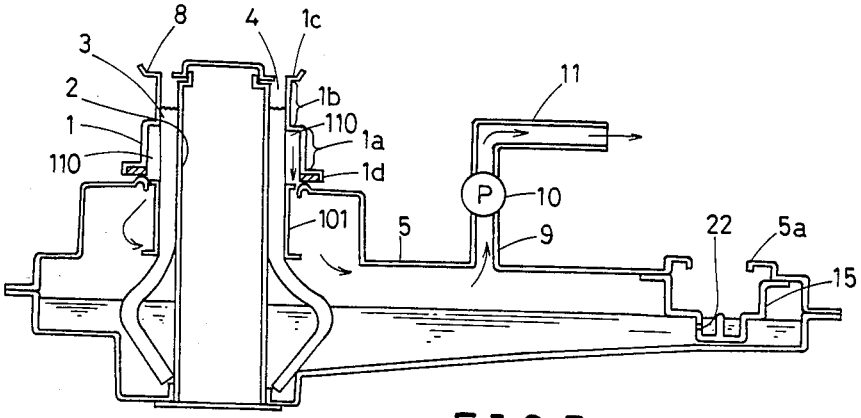
FIG. 5 shows a cross-sectional view of a movable wick type oil stove including a deodorizing device according to a fourth preferred embodiment of the present invention.

FIG. 5 shows a cross-sectional view of a movable wick type oil stove including a deodorizing device according to a fourth preferred embodiment of the present invention when the wick 3 is moved down so as to extinguish the burning portion at the top of wick 3.

The top of the wick 3 when extinguished is positioned at the upper vertical wall 1*b*. A gas absorbing passage 110 is formed between the wick 3 and the vertical portion of the stair portion 1*a* of the outer wick cylinder 1. The gas absorbing passage 110 is communication with the inside of the fuel container 5. The suction pipe 9 is integrally provided at the upper wall of the fuel container 5 and connected with the exhaust pipe 11 through the suction pump 10 of the suction device so as to absorb the gas in the fuel container 5. If the inner pressure of the fuel container 5 is increased to more than that of the atmosphere by thermoexpansion of air in the fuel container 5 during the combustion of the top of the wick 3, the burning portion at the top of the wick is suddenly raised. To prevent the rising of the burning portion at the top of the wick 3, a communicating hole 22 is provided with the oil saucer 15 of the fuel container 5. The inside of the fuel container 5 is in communication with the atmosphere through the communicating hole 22 to prevent the inner pressure of the fuel container 5 from increasing.

Since the communicating hole 22 is in communication with the atmosphere, the inner pressure of the fuel container 5 is not negative (below atmospheric) even when the gas in the fuel container 5 is absorbed into the suction pipe 9 by the suction pump 10.

The communicating hole 22 is positioned at the portion above the upper surface of oil 6 in the fuel container 5 when the top portion of the wick 3 is burning, so that the inside of the fuel container 5 is in communication with the atmosphere. On the other hand, the communicating hole 22 is positioned at the portion lower than the upper surface of oil 6 in the fuel container 5 by dipping the lower portion of the wick 3 in the oil 6 when the burning portion of the top of the wick 3 is extinguished, so that the communicating hole 22 is closed by the oil. Accordingly, the inside of the fuel container 5 is only in communication with the atmosphere through the wick guide passage 4 and the gas absorbing passage 110 when the burning portion of the top of the wick 3 is extinguished.

Figure 6:
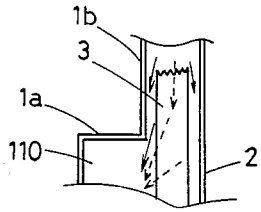
FIG. 6 shows a cross-sectional view for explaining a gas absorbing passage of the deodorizing device of FIG. 5.

When the top of the wick 3 is moved down in the wick guide passage 4 to thereby operate the extinguishment lever or a movement sensing device (not shown), the suction pump 10 of the suction device is driven and the gas in the fuel container 5 is absorbed into the suction pipe 9. The unburned gases or the incomplete combustion gases produced from the burning top of the wick 3 are forwarded in the lower direction through the wick guide passage 4 and the gas absorbing passage 110 and introduced into the suction pipe 9 through the inside of the fuel container 5, and finally, exhausted from the exhaust pipe 11 into the atmosphere. As the inner pressure of the fuel container 5 becomes negative when the wick 3 is moved down, the pressure of the gas absorbing passage 10 becomes negative, also. Accordingly, the unburned gas or the incomplete combustion gas produced from the entire top of the cylindrical wick 3 is introduced into the gas absorbing passage 110 through the spaces between the outer wick cylinder 1 and the wick 3, and between the wick 3 and the inner wick cylinder 2, as shown in FIG. 6.

Figure 7:
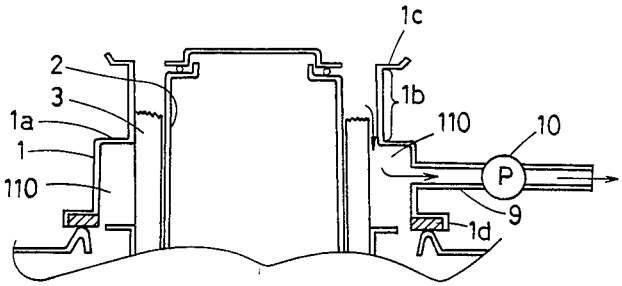
FIG. 7 shows a cross-sectional view of an improved deodorizing device of FIG. 5.

The suction pipe 9 may be provided at the position in communication with the gas absorbing passage 110. For example, as shown in FIG. 7, the suction pipe 9 may be provided at the vertical wall of the stair portion 1*a* of the outer wick cylinder 1 so as to directly connect the suction pipe 9 with the gas absorbing passage 110. The oil absorbing passage 110 may be formed between the inner wick cylinder 2 and the wick 3.

Figure 8:
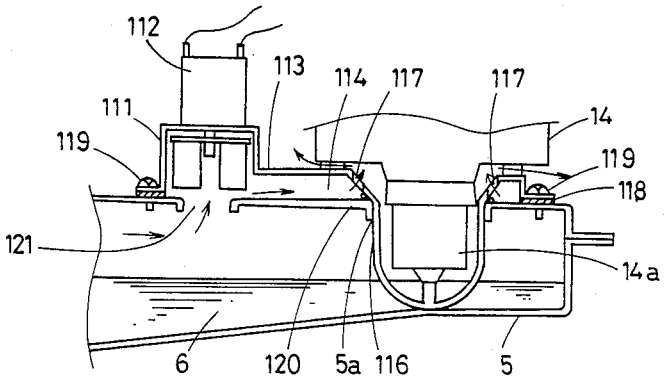
FIG. 8 shows a cross-sectional view of a movable wick type oil stove including a deodorizing device according to a fifth preferred embodiment of the present invention.

FIG. 8 shows a cross-sectional view of a movable wick type oil stove including a deodorizing device according to a fifth preferred embodiment of the present invention when extinguished. A suction hole 121 is provided at the upper wall of the fuel container 5. A suction fan 111 and a motor 112 are disposed over the upper wall of the fuel container 5 around the suction hole 121 via a casing 113. The motor 112 is installed on the casing 113 and is driven to rotate the suction fan 111.

An exhaust duct 114 is formed between the end of the casing 113 and the upper wall of the fuel container 5. The casing 113 is integrally provided with a "U" shaped oil saucer 116 as shown in FIG. 8. The "U" shaped oil saucer 116 has a plurality of exhaust holes 117 at its upper edges. The casing 113 is secured to the upper wall of the fuel container 5 by a plurality of screws 119 through a packing 118 so as to prevent the oil 6 in the fuel container 5 from leaking even when the stove falls. 120 designates an oil supply portion packing for sealing the oil supply portion 5*b* of the fuel container 5 with the oil saucer 116. In the embodiment of FIG. 8, when the wick 3 is moved down to be extinguished, the motor 112 is driven to rotate the fan 111, so that the unburned gases and the incomplete combustion gases from the uncooled top of the wick 3 are introduced into the fuel container 5 through the wick guide passage 4 and the gas absorbing passage 110. The absorbed gas is, further, introduced into the exhaust duct 114. The part of the absorbed gas discharged from the exhaust duct 114 is liquefied, and then, the liquefied gas oil is forwarded to the oil saucer 116. The remaining absorbed gas is exhausted from the plurality of exhaust holes 117 into the atmosphere.

Figure 9:
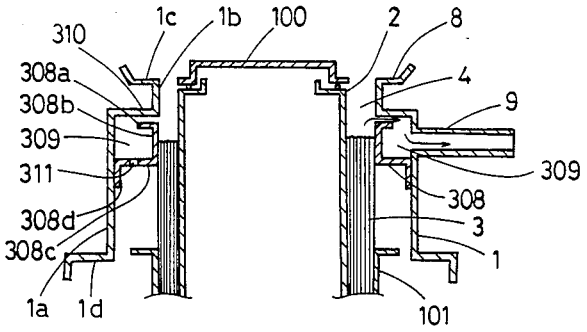
FIG. 9 shows a cross-sectional view of a deodorizing device in a movable wick type oil stove according to a sixth preferred embodiment of the present invention.

FIG. 9 shows a cross-sectional view of a deodorizing device in a movable wick type oil stove according to a sixth preferred embodiment of the present invention when extinguished.

The suction pipe 9 is provided at the vertical wall of the stair portion 1*a*. An "S" shaped metal ring 308 is inserted between the inner surface of the stair portion 1*a* and the wick 3. The "S" shaped metal ring 308 comprises a first cylindrical portion 308*b* having a hook 308*a*, a horizontal portion 308*c*, and a second cylindrical portion 308*d*. The diameter of the second cylindrical portion 308*d* is greater than that of the first cylindrical portion 308*b*. A ring-like gas absorbing passage 310 having a narrow space is formed between the horizontal portion of the stair portion 1*a* and the hook 308*a* to absorb the unburned gases or the incomplete combustion gases into a ring-like absorbing duct 309. The ring-like absorbing duct 309 is formed by the "S" shaped metal ring 308 and the outer wick cylinder 1 and is in communication with the suction pipe 9. The vertical portion of the stair portion 1*a* of the outer wick cylinder 1 is connected with the second cylindrical portion 308*d* of the "S" shaped metal ring 308 by spot soldering. The cross-sectional view of the ring-like absorbing duct 309 is in a rectangular form. The suction pipe 9 is connected with the suction pump of the suction device (not shown). Oil feedback openings 311 are provided at the horizontal portion 308*c* for introducing the liquefied gas oil from the absorbing duct 309 into the fuel container 5.

When the suction pump is driven by starting the extinguishment of the burning portion at the top of the wick 3, the unburned gases or the incomplete combustion gases produced from the whole top of the wick 3 are absorbed into the absorbing duct 309 through the gas absorbing passage 310 and introduced into the suction pipe 9. The part of the absorbed gas is condensed into a liquid of oil by passing itself through the absorbing duct 309, and the liquefied gas oil is introduced into the fuel container 5 through the oil feedback openings 311.

Figure 10:
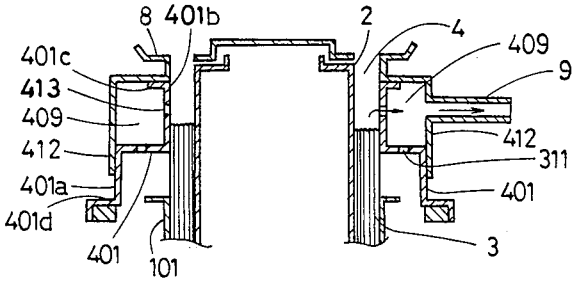
FIG. 10 shows a cross-sectional view of a deodorizing device in a movable wick type oil stove according to a seventh preferred embodiment of the present invention.

FIG. 10 shows a cross-sectional view of a deodorizing device in a movable wick type oil stove according to a seventh preferred embodiment of the present invention when extinguished. The outer wick cylinder 1 comprises a reversed "L" shaped cylinder 412 having an upper end portion facing outward to constitute a burner mounting flange as the burner rest portion 8, and a wick guide cylinder 401 in a stepwise form having a lower end portion 401*d* facing outward to rest in the fuel container 5 and an upper end portion 401*c* facing outward. The wick guide cylinder 401 further comprises an upper vertical wall 401*b* for supporting the wick 3 and a stair portion 401*a*. The reversed "L" shaped cylinder 412 and the wick guide cylinder 401 are adhered each other by soldering to form a gas absorbing duct 409. A plurality of absorbing apertures 413 are provided at the upper vertical wall 401*b* of the wick guide cylinder 401 above the position of the top of the wick 3 when extinguished. The plurality of absorbing apertures 413 are uniformly separated each other.

Figure 11:
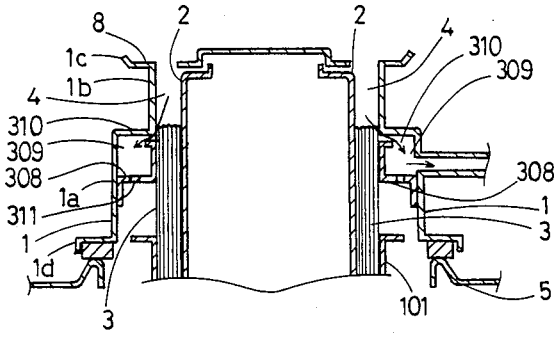
FIG. 11 shows a cross-sectional view of an improved deodorizing deivce of FIG. 9.

The gas absorbing duct 409 of FIG. 9 may be provided as shown in FIG. 11. For example, the gas absorbing duct 409 is provided at the position lower than the top of the wick 3 when extinguished.

In the present invention, the absorbing duct 309 or 409 may be provided at the side of the inner wick cylinder 2. Also, the suction pipe 9 and the suction pump 10 may be provided in the inner wick cylinder 2.

According to the present invention, the deodorizing device is operated when the wick 3 is moved down by the predetermined position to start the extingushment of the burning portion at the top of the wick 3. On the other hand, the deodorizing device stops operating when the top of the wick 3 is cooled and stops producing the unburned gas. For example, the driving period of the deodorizing device is about one minute. The suction pump or the absorbing motor is controlled by a timer switch of a control circuit of the deodorizing device. Next, the operation of the control circuit will be described with reference to FIGS. 12, 14(A) and 14(B).

A power source 200 such as a direct current power source of 3 Volts is connected with the suction pump 9 or the driving motor for driving the deodorizing device. The power source 200 may be a battery for automatically igniting the top of the wick for the movable wick type oil stove. A switch 201 is operated by communicating with a wick moving device device (not shown) for moving the wick 3 in the vertical direction. For example, a cam 202 disposed at the circumference of a wick position control knob 204 in the wick moving device operates the switch 201 such as a microswitch attached to the main body of the oil stove.

Figure 12:
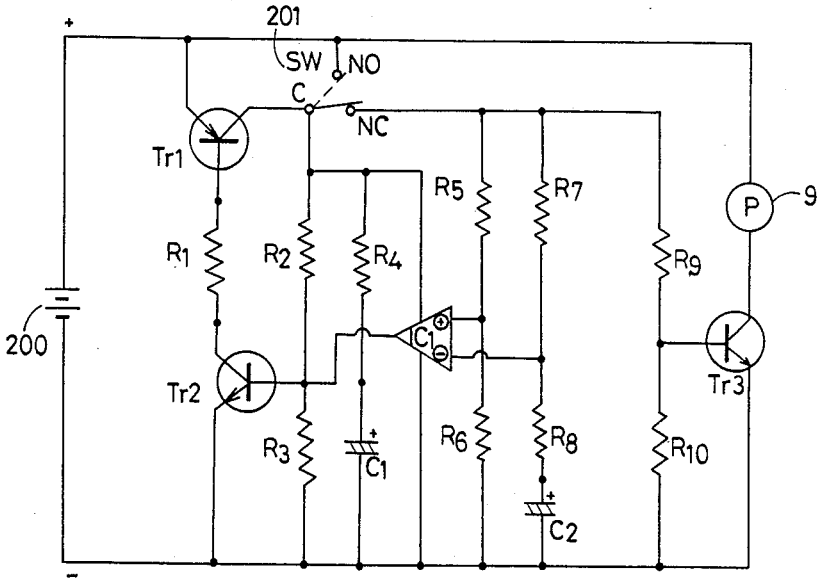
FIG. 12 shows a circuit diagram of the deodorizing device of the present invention.

When the oil stove is in a combustion operation, a switching contact C of the switch 201 is connected with a fixed contact NO of the switch 201 as shown by a dotted line in FIG. 12. On the other hand, when the oil stove is in an extinguishment operation, the switching contact C is connected with a fixed contact NC of the switch 201 as shown by a continuous line in FIG. 12.

A control circuit 203 controls the driving of the suction pump 9 based on the switching of the switch 201. The control circuit 203 includes a switching circuit, a back-up power circuit, and a timer circuit. The switching circuit comprises three transistors Tr1, Tr2 and Tr3, and five resistors R1, R2, R3, R9 and R10. The back-up power circuit comprises a capacitor C1 and a resistor R4. The timer circuit comprises a comparator IC1, a capacitor C2 and four resistors R5, R6, R7 and R8.

First, the switching circuit will be described. One terminal of the suction pump 9 is connected with the positive end of the power source 200, and the other terminal of the suction pump 9 is connected with the negative end of the power source 200 through the collector and the emitter of the transistor Tr3 to form a main circuit. To obtain a bias for switchingly operating the transistor Tr3, the base of the transistor Tr3 is connected with the negative end of the power source 200 through the resistance R10 and, further, is connected with a fixed contact NC of the switch 201 through the resistance R9. A switching contact C of the switch 201 is connected with the positive end of the power source 200 through the collector and the emitter of the transistor Tr1, and the fixed contact NO of the switch 201 is directly connected with the positive side of the power source 200. The base of the transistor Tr1 is connected with the negative end of the power source 200 through the resistance R1 and the collector and the emitter of the transistor Tr2. The base of the transistor Tr2 is connected with the switching contact C of the switch 201 through the resistor R2 and connected with the negative end of the power cource 201 through the resistance R3, and further, connected with an output terminal of the comparator IC1. The switching contact C of the switch 201 is connected with the positive end of the power source 200 through the back-up power circuit such as a series circuit comprising the resistor R4 and the capacitor C1.

Next, the timer circuit will be described. A power source of the comparator IC1 is connected with a switching contact C of the switch 201 and the ground of the comparator IC1 is connected with the positive end of the power source 200. The positive input terminal "+" of the comparator IC1 is connected with the fixed contact NC of the switch 201 through the resistor R5 and connected with the negative end of the power source 224 through the resistor R6. The negative input terminal "−" of the comparator IC1 is connected with the fixed contact NC of the switch 201 through the resistor R7 and connected with the positive end of the power source 200 through the series circuit comprising the resistor R6 and the capacitor C2.

Figure 14:
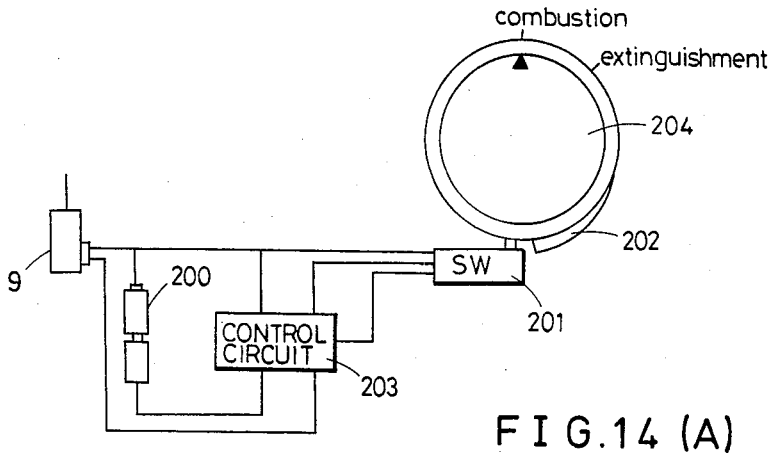
FIGS. 14(A) and 14(B) show drawings for explaining the operation of the deodorizing device of the present invention.
Figure 14:
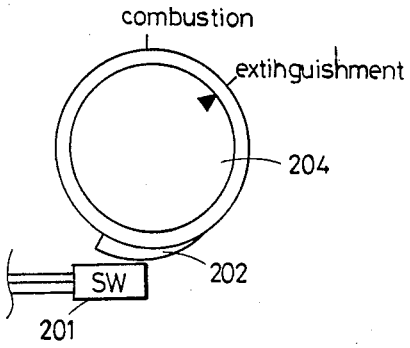

In the above control circuit, when the stove is in a combustion operation as shown in FIG. 14(A), the switching contact C of the switch 201 is connected with the fixed contact NO as shown by the dotted line in FIG. 12. Because the bias is not applied to the base of the transistor Tr3, the driving motor of the suction pump 9 is not driven, but the capacitor C1 of the back-up power circuit charges by the bias. When the top of the wick 3 is moved down to thereby operate the extinguishment lever or the movement-sensing device, the wick control knob 204 is rotated in the left direction as shown in FIG. 14(B) to extinguish the fired portion of the top of the wick 3. The switching contact C of the switch 201 is connected with the fixed contact NC as shown by the continuous line in FIG. 12. In this case, the capaciotor C1 of the back-up power circuit serves as the direct current power source, and a current from the capacitor C1 is applied to the resistors R4, R2 and R3, and the bias is applied to the base of the transistor Tr2, so that the transistor Tr2 turns ON, and further, the transistor Tr1 turns ON. As a result, the bias is applied to the base of the transistor Tr3 so that the transistor Tr3 turns on and the suction motor of the suction pump 9 is driven. At the same time, the capacitor C2 of the timer circuit starts charging and is gradually charged. After a predetermined period, when the voltage at the negative input terminal "−" of the comparator IC1 is greater than that of the positive input terminal "+" of the comparator IC1, the output of the comparator IC1 charges from a high level to a low level. As the bias is not applied to the transistor Tr3, the transistor Tr2 changes from the ON condition to the OFF condition. According to the OFF condition of the transistor Tr2, the transistor Tr1 turns OFF. According to the OFF condition of the transistor Tr1, the transistor Tr3 turns OFF. Finally, the suction motor of the suction pump 9 stops driving. The charges accumulated in the capacitor C2 are naturally discharged through the resistors R6, R7 and various resistors to operate the timer circuit when a next extiniguishment operation is performed.

Figure 13:
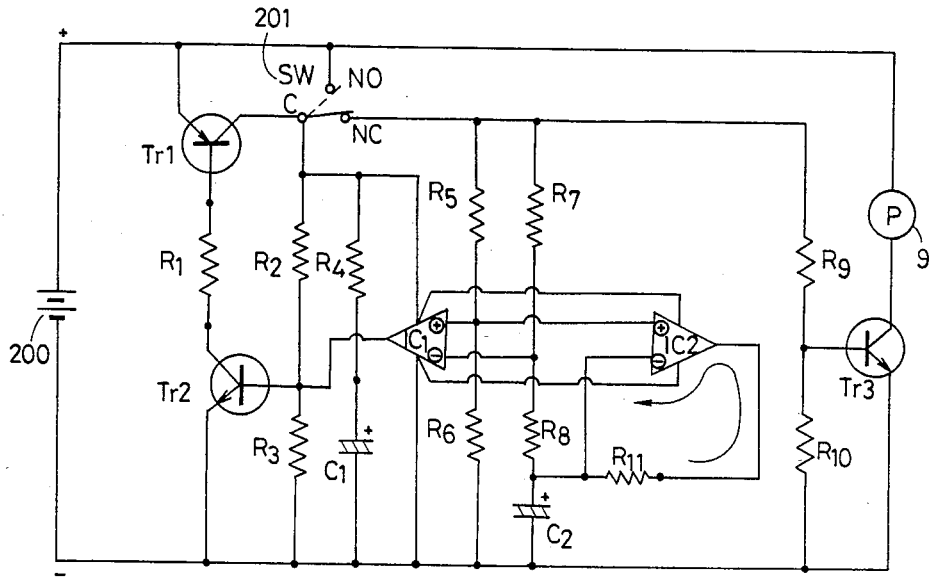
FIG. 13 shows another circuit diagram of the deodorizing device of the present invention.

In the above control circuit, the electric discharge of the capacitor C2 takes a long time. If the combustion operation and the extinguishment operation are alternatively repeated during a short time, the time calculating operation of the timer circuit is unstable. To enable a stable time calculating operation of the timer circuit, a reset ciruit for the timer circuit may be additionally provided in the circuit of FIG. 12. Such a circuit is as shown in FIG. 13. The electric discharge of the capacitor C2 of the timer circuit is forcibly performed by the reset circuit based on the switching operation of the switch 201. The reset circuit comprises a comparator IC2 and a resistance R11, and is connected with the time circuit. The positive input terminal "+" of the comparator IC2 is connected with the positive input terminal of the comparator IC1. The negative terminal "−" of the comparator IC2 is connected with the connecting portion between the resistance R8 and the capacitor C2. The output terminal of the comparator IC2 is connected with a connecting portion between the reistance R8 and the capacitor C2 through the resistance R11. The comparator IC1 and the comparator IC2 are integrally provided as an integrated circuit (IC) of 8 bits, so that the power source and the ground of the comparator IC1 are connected with the power source and the ground of the comparator IC2, respectively.

The operation of the reset circuit will be described. As shown in FIG. 14(A), when the wick control knob 204 is rotated in the right direction so as to move up the wick 3, the stove is in the combustion operation. In this time, the switching contact C of the switch 201 is not connected with the fixed contact CN of the switch 201. If the capacitor C2 is charged without naturally discharging, the voltage of the negative input terminal "−" of the comparator IC2 is greater than that of the positive input terminal "+" of the comparator IC2, so that the output of the output terminal of the comaprator IC2 changes from a high level to a low level and the charges accumulated in the capactor C2 are attracted by the comparator IC2 as shown by an arrow direction of FIG. 13 so as to forcibly discharge the capacitor C2. Accordingly, the capacitor C2 is charged from a O voltage level according to the next extinguishment operation. When the capacitor C2 is charged by a predetermined voltage, the timer circuit is operated. Because the reset circuit for the timer circuit is provided, even when the combustion operation and the extinguishment operation are alternatively repeated in a short time, the time calculating operation of the timer circuit is accurately operated. In the operation of the timer circuit based on the extinguishment operation, because the voltage of the negative input terminal "−" of the comparator IC2 is lower by a voltage drop of the resistance R8 than that of the negative terminal "−" of the comparator IC1, the output of the comparator IC2 is not inverted before the output of the comparator IC1 is inverted, so that the capacitor C2 is not forcibly discharged.

The oil stove for the present invention is not limited to the movable wick type oil stove. The deodorizing device according to the present invention may be applied to various type of oil stoves.

As described above, according to the deodorizing device of the present invention, because the unburned gas or the incomplete combustion gas produced from the slight and pale burning portion at the whole top of the cylindrical wick when extinguished is absorbed and removed, the oboxious and nasty smells can be eliminated. Also, as the operation of the deodorizing device is controlled by the timer circuit, the deodorizing device can be accurately operated even when the extinguisment and the combustion operations are alternatively repeated in a short time.

In the present invention, a gas sensor may be provided in place of the timer circuit. The gas sensor detects the generation of the unburned gas or the incomplete combustion gas from the wick causing obnoxious and nasty smells. When the gas sensor detects the gas, the deodorizing device is operated. On the other hand, when the gas sensor does not detect the gas, the deodorizing device is not operated.

The invention being thus described, it will be obvious that the same may be varied in many ways. Such variations are not to be regarded as a departure from the spirit and scope of the invention, and all such modifications are intended to be included within the scope of the following claims.

What is claimed is:

1. An oil stove, comprising:

container means for storing fuel therein;

a first cylindrical means, mounted on said container means, for supporting a wick;

a second cylindrical means, positioned inside of said first cylindrical means and extending into said container means, for supporting a wick;

a combustion wick positioned between said first and second cylindrical means, movable in a vertical direction along said first and second cylinder means, and having one end thereof extending into said container means for absorbing fuel from said container means;

adjustment means for permitting adjustment of a vertical position of said wick so that upon moving said wick upward an upper-end thereof can be ignited, and upon moving said wick downward, said upper end can be extinguished; and deodorizing means for absorbing or removing any combustion gases and unburned gases when said upper-end of said wick is ignited and thereafter extinguished, said deodorizing means including:

detecting means for detecting the vertical movement of said wick means, and suction means actuated by said detecting means for absorbing or removing combustion gases and unburned gases produced as a result of extinguishment of said upper end of said wick.

2. The oil stove according to claim 1, wherein upper ends of said first and second cylindrical means form flanges for mounting burners.

3. The oil stove according to claim 1, wherein a lower portion of said first cylindrical means is stair-shaped.

4. The oil stove according to claim 1, further comprising a means located in said container means for holding said wick against said second cylindrical means and responsive to said means for permitting adjustment of the vertical position of said wick.

5. The oil stove according to claim 1, wherein said suction means includes a pipe connected to an upper wall of said first cylindrical means at a position above the vertical position of said wick after said wick is extinguished, and a suction pump for withdrawing combustion gases and unburned gases from said pipe.

6. The oil stove according to claim 1, further comprising:

a fuel supply tank connected to a first aperture in said container means;

a second suction aperture formed in an upper wall of said container means;

casing means formed around said second suction aperture;

a U-shaped oil saucer attached to said casing means and to an upper wall of said fuel container means, and having a plurality of exhaust holes formed at upper edges thereof, said U-shaped saucer positioned in said aperture of said fuel container means; and suction means disposed on said suction aperture for drawing combustion gases and unburned gases into said fuel container means and passing combustion gases and unburned gases through said exhaust holes, so that a portion of both gases passes into the atmosphere and another portion is condensed and returns to said fuel container means via said saucer.

7. The oil stove according to claim 3, wherein a passage is formed between said wick and said stair-shaped portion of said first cylindrical means.

8. The oil stove according to claim 7, wherein said suction means further includes a pipe connected to said stair-shaped portion of said cylindrical means and a suction pump connected to said pipe for withdrawing gases from said pipe.

9. The oil stove according to claim 8, further comprising a metal ring provided between an inner surface of said stair-shaped portion and said wick, said metal ring including:

a first cylindrical portion having a hook portion and a horizontal portion, and a second cylindrical portion having a diameter greater than that of said first cylindrical portion, for forming a gas-absorbing passage to absorb said unburned gases and said combustion gases in an absorbing duct, said absorbing duct formed between said metal ring and said pipe.

10. The oil stove according to claim 8, wherein said first cylindrical means comprises a cylinder having an upper end portion facing outwardly to constitute a burner mounting flange, and a wick guide cylinder having a lower end portion facing outward to rest in said fuel container means and an upper end portion facing outward, said wick guide cylinder further comprising an upper vertical wall for supporting said wick and a stair-shaped portion, said cylinder and said cylinder wick guide being connected so as to form a gas absorbing duct.

11. The oil stove according to claim 9, wherein said metal ring further includes an aperture formed in said horizontal portion for conveying any liquified gases into said fuel container means.

12. The oil stove according to claim 10, wherein said gas absorbing duct is provided at a position lower than the top of said wick when said wick is extinguished.

13. The oil stove according to claim 5, further comprising an exhaust pipe connected to a first pipe for condensing a portion of combustion gases and unburned gases produced as a result of extinguishment of said upper end of said wick and for returning said condensed portion of gases to said container means and to a second pipe for exhausting any of said combustion gases and said unburned gases which have not condensed into the atmosphere.

14. The oil stove according to claim 5, further comprising a fuel supply tank connected to an aperture in said container means.

15. The oil stove according to claim 10, wherein said deodorizing means further includes an exhaust pipe having one end connected to said suction means and the other end connected to a connection point of said fuel supply tank and said aperture, for condensing a portion of said gases and returning said condensed portion into said aperture.

16. The oil stove according to claim 1, wherein said suction means includes a pipe connected to an upper wall of said container means and a suction pump for withdrawing gases from said pipe.

* * * * *